US008014701B2

(12) United States Patent
Nakura et al.

(10) Patent No.: US 8,014,701 B2
(45) Date of Patent: Sep. 6, 2011

(54) CONTACTING AND SEPARATING MECHANISM AND IMAGE FORMING APPARATUS

(75) Inventors: Makoto Nakura, Ibaraki (JP); Junji Shirakawa, Ibaraki (JP); Hiroshi Suzuki, Ibaraki (JP)

(73) Assignee: Ricoh Company, Ltd., Tokyo (JP)

( * ) Notice: Subject to any disclaimer, the term of this patent is extended or adjusted under 35 U.S.C. 154(b) by 347 days.

(21) Appl. No.: 12/334,803

(22) Filed: Dec. 15, 2008

(65) Prior Publication Data

US 2009/0162114 A1 Jun. 25, 2009

(30) Foreign Application Priority Data

Dec. 17, 2007 (JP) ..... 2007-325236

(51) Int. Cl.
*G03G 15/08* (2006.01)

(52) U.S. Cl. ..... 399/121; 399/107; 399/110; 399/122; 399/123; 399/297; 399/310; 399/313; 399/330; 399/331; 399/343; 399/345

(58) Field of Classification Search ..... 399/107, 399/110, 121–123, 297, 310, 313, 330, 331, 399/343, 345

See application file for complete search history.

(56) References Cited

U.S. PATENT DOCUMENTS

| | | | | |
|---|---|---|---|---|
| 5,182,602 | A * | 1/1993 | Kakita et al. | 399/297 |
| 5,426,496 | A * | 6/1995 | Koike et al. | 399/381 |
| 2005/0158074 | A1 * | 7/2005 | Murakami et al. | 399/121 |
| 2008/0232866 | A1 | 9/2008 | Shoji et al. | |
| 2008/0240802 | A1 | 10/2008 | Nakura | |
| 2008/0267673 | A1 | 10/2008 | Tao et al. | |

FOREIGN PATENT DOCUMENTS

| | | |
|---|---|---|
| JP | 11-30896 | 2/1999 |
| JP | 2000-122445 | 4/2000 |
| JP | 2001-201954 | 7/2001 |
| JP | 2002-49215 | 2/2002 |
| JP | 2004-252258 | 9/2004 |
| JP | 2005-301216 | 10/2005 |

* cited by examiner

*Primary Examiner* — David Porta
*Assistant Examiner* — Shun Lee
(74) *Attorney, Agent, or Firm* — Oblon, Spivak, McClelland, Maier & Neustadt, L.L.P.

(57) ABSTRACT

A contacting and separating mechanism which causes a first member to contact a second member and separates the first member contacting the second member from the second member is disclosed. The contacting and separating mechanism includes a pressure applying member which is rotated together with the first member by using a force of a first force applying member with a first supporting point as the center and causes the first member to contact the second member and separates the first member contacting the second member from the second member, and separates the first member contacting the second member from the second member by rotating with the first member with a second supporting point as the center by changing the position of the first supporting point.

13 Claims, 5 Drawing Sheets

CONTACTING AND SEPARATING MECHANISM AND IMAGE FORMING APPARATUS

BACKGROUND OF THE INVENTION

1. Field of the Invention

The present invention generally relates to a contacting and separating mechanism which causes a first member to contact a second member and separates the first member contacting the second member from the second member and an image forming apparatus using the contacting and separating mechanism such as a copying apparatus, a printer, a facsimile machine, and a multifunctional apparatus having the above functions.

2. Description of the Related Art

Conventionally, in an image forming apparatus such as a copying apparatus and a printer, a contacting and separating mechanism, which causes a member to be contacted such as a secondary transfer roller to contact a contacting member such as an intermediate transfer belt (image carrier) and separates the member contacting the contacting member from the contacting member, has been widely used (see Patent Documents 1 through 3).

In an image forming apparatus in Patent Document 1, four photoconductor drums are arrayed to face an intermediate transfer belt. On the four photoconductor drums, a black toner image, a yellow toner image, a magenta toner image, and a cyan toner image are formed, respectively. The four toner images are transferred onto the intermediate transfer belt by being superposed. The superposed toner image on the intermediate transfer belt is transferred onto a recording medium at a position where the intermediate transfer belt contacts a secondary transfer roller.

In the image forming apparatus, in order to reduce the wear and deterioration of the intermediate transfer belt and the secondary transfer roller caused by the friction between the intermediate transfer belt and the secondary transfer roller, or in order to remove a recording medium jammed at a position where the intermediate transfer belt contacts the secondary transfer roller, a contacting and separating mechanism is provided which automatically causes the secondary transfer roller to contact the intermediate transfer belt and automatically separates the secondary transfer roller from the intermediate transfer belt.

Specifically, in Patent Document 1, by a roller pressure applying lever (pressure applying member) whose rotation supporting point is near the secondary transfer roller, the secondary transfer roller is caused to contact the intermediate transfer belt. When a cam contacting the roller pressure applying lever is rotated to a predetermined angle, the roller pressure applying lever is pushed downward against a spring force which pushes the roller pressure applying lever. With this, the secondary transfer roller is separated from the intermediate transfer belt.

In Patent Document 1, in order to replace the secondary transfer roller with a new one, a rotation supporting point for moving the secondary transfer roller by its own weight is provided, in addition to the rotation supporting point of the roller pressure applying lever.

In Patent Document 2, a secondary transfer frame pressure applying metal plate and a secondary transfer member (pressure applying member) whose rotation supporting point is near the secondary transfer roller pushes the secondary transfer roller to the intermediate transfer belt. When a cam is rotated to a predetermined angle, which cam is disposed under the secondary transfer roller, and contacts the secondary transfer frame pressure applying metal plate, a spring force pushing the secondary transfer frame pressure applying metal plate and the secondary transfer member is released. With this, the secondary transfer roller is separated from the intermediate transfer belt.

In Patent Document 3, a secondary transfer unit (pressure applying member) whose rotation supporting point is separated from the secondary transfer roller causes the secondary transfer roller to contact the intermediate transfer belt. When a cam is rotated to a predetermined angle, which cam is disposed under the secondary transfer roller and contacts the secondary transfer unit, the secondary transfer roller is separated from the intermediate transfer belt.

[Patent Document 1] Japanese Unexamined Patent Publication No. 2004-252258

[Patent Document 2] Japanese Unexamined Patent Publication No. H11-030896

[Patent Document 3] Japanese Unexamined Patent Publication No. 2001-201954

However, in the image forming apparatus, when, for example, a power source of the apparatus is cut off and an automatic contacting and separating mechanism which is moved by a motor is not operated, in order to remove a recording medium jammed at a position where the intermediate transfer belt contacts the secondary transfer roller, or in order to perform maintenance of the intermediate transfer belt and the secondary transfer roller, a manual separating mechanism which manually separates the secondary transfer roller from the intermediate transfer belt must be provided.

However, in a case where the manual separating mechanism is attached to the automatic contacting and separating mechanism, when a manually operable cam (manual cam) contacts the pressure applying member of the automatic contacting and separating mechanism while using the pressure applying member and the rotation supporting point of the automatic contacting and separating mechanism as they are, a great force may be required for the manual operation or pressure deviation may be generated in the width direction of the secondary transfer roller which contacts the intermediate transfer belt.

That is, in order to increase the operability of the manual separating mechanism, in a case where the rotation supporting point of the pressure applying member rotating with the secondary transfer roller is disposed near the secondary transfer roller and the manual cam is disposed at a position separated from the secondary transfer roller, when the parallelism between the secondary transfer roller and the rotation supporting point of the pressure applying member is not accurately obtained, the pressure deviation in the width direction of the secondary transfer roller which contacts the intermediate transfer belt becomes great.

Specifically, in Patent Documents 1 and 2, since the rotation supporting point of the pressure applying member is near the secondary transfer roller, the pressure deviation in the width direction of the secondary transfer roller which contacts the intermediate transfer belt may be great.

In addition, in Patent Document 1, when the secondary transfer roller is replaced with a new one, the rotation supporting point for moving the secondary transfer roller by its own weight is formed, in addition to the rotation supporting point of the pressure applying member. However, the above problem is not solved and the size of the apparatus becomes large.

In Patent Document 3, since the rotation supporting point of the pressure applying member is at a position separated from the secondary transfer roller, the pressure deviation of the secondary transfer roller is relatively small at the contacting position with the intermediate transfer belt; however, when the cam is manually moved, a large force is required.

The above problems are not limited to the separating mechanism in which the secondary transfer roller is separated from the intermediate transfer belt. That is, the problems are common in all the separating mechanisms in which a member contacting another member is separated from the other member.

SUMMARY OF THE INVENTION

In a preferred embodiment of the present invention, there is provided a contacting and separating mechanism and an image forming apparatus using the mechanism which separates a first member (member to be contacted) contacting a second member (where the member to be contacted contacts) from the second member by having a relatively simple and small structure, without having a large force when the first member is separated from the second member, and without generating pressure deviation in the width direction of the first member.

Features and advantages of the present invention are set forth in the description that follows, and in part will become apparent from the description and the accompanying drawings, or may be learned by practice of the invention according to the teachings provided in the description. Features and advantages of the present invention will be realized and attained by a contacting and separating mechanism and an image forming apparatus using the mechanism particularly pointed out in the specification in such full, clear, concise, and exact terms so as to enable a person having ordinary skill in the art to practice the invention.

To achieve one or more of these and other advantages, according to one aspect of the present invention, there is provided a contacting and separating mechanism which causes a first member to contact a second member and separates the first member contacting the second member from the second member. The contacting and separating mechanism includes a pressure applying member which is rotated together with the first member by using a force of a first force applying member with a first supporting point as the center and causes the first member to contact the second member and separates the first member contacting the second member from the second member, and separates the first member contacting the second member from the second member by rotating with the first member with a second supporting point as the center by changing the position of the first supporting point.

According to another aspect of the present invention, there is provided an image forming apparatus. The image forming apparatus includes a contacting and separating mechanism which causes a first member to contact a second member and separates the first member contacting the second member from the second member. The contacting and separating mechanism includes a pressure applying member which is rotated together with the first member by using a force of a first force applying member with a first supporting point as the center and causes the first member to contact the second member and separates the first member contacting the second member from the second member, and separates the first member contacting the second member from the second member by rotating with the first member with a second supporting point as the center by changing the position of the first supporting point.

EFFECT OF THE INVENTION

According to an embodiment of the present invention, in a contacting and separating mechanism, a rotation supporting point of a pressure applying member when a first member is caused to contact a second member is different from a rotation supporting point of the pressure applying member when the first member is separated from the second member. Therefore, the contacting and separating mechanism can be realized in which the structure is relatively simple and small, a large force is not required when the first member is separated from the second member, and there is no pressure deviation in the width direction of the first member.

BRIEF DESCRIPTION OF THE DRAWINGS

Features and advantages of the present invention will become more apparent from the following detailed description when read in conjunction with the accompanying drawings, in which.

DESCRIPTION OF THE PREFERRED EMBODIMENT

Best Mode of Carrying Out the Invention

The best mode of carrying out the present invention is described with reference to the accompanying drawings.

Figure 1:
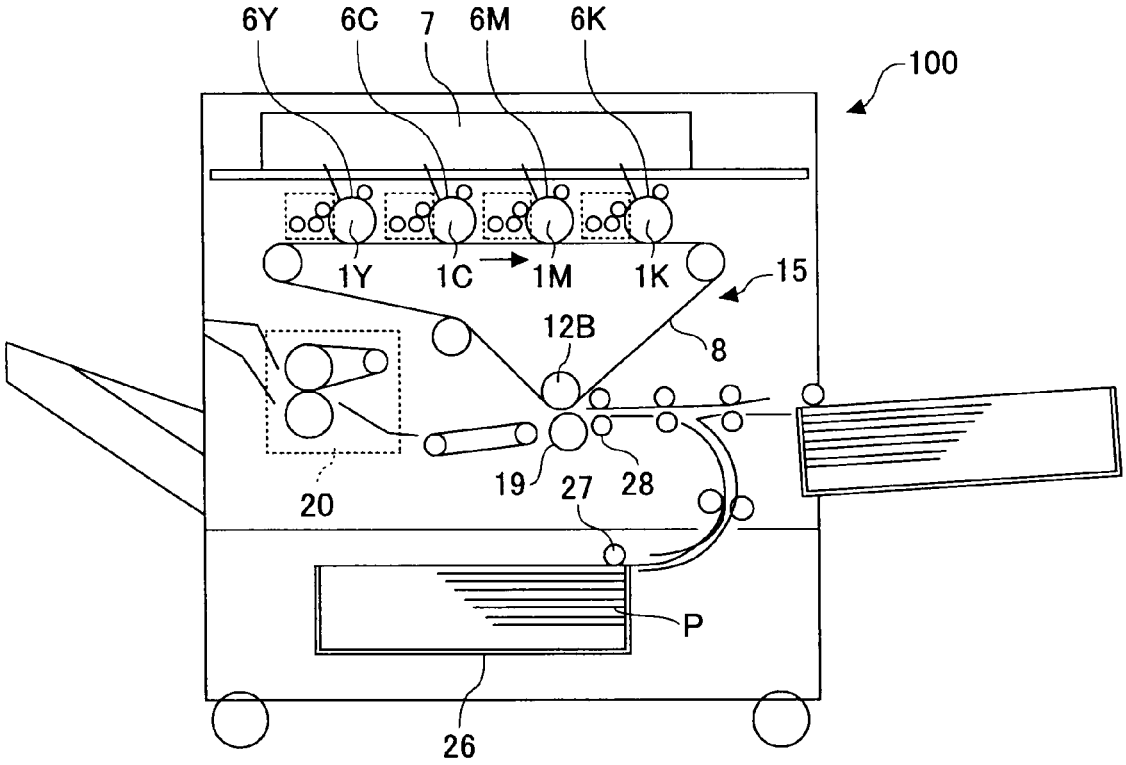
FIG. 1 is a schematic diagram showing an image forming apparatus according to an embodiment of the present invention.
Figure 2:
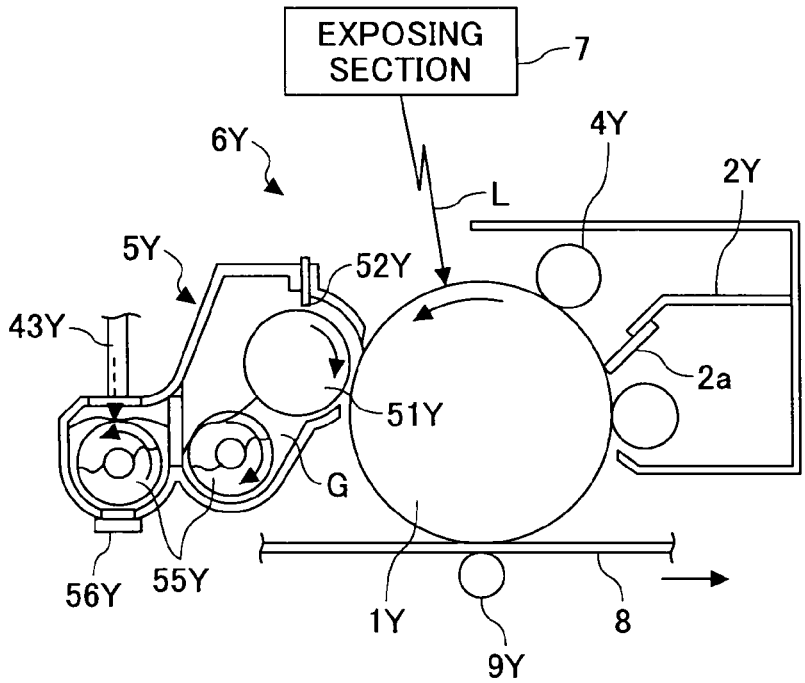
FIG. 2 is an enlarged view of an image forming section of the image forming apparatus shown in FIG. 1.
Figure 3:
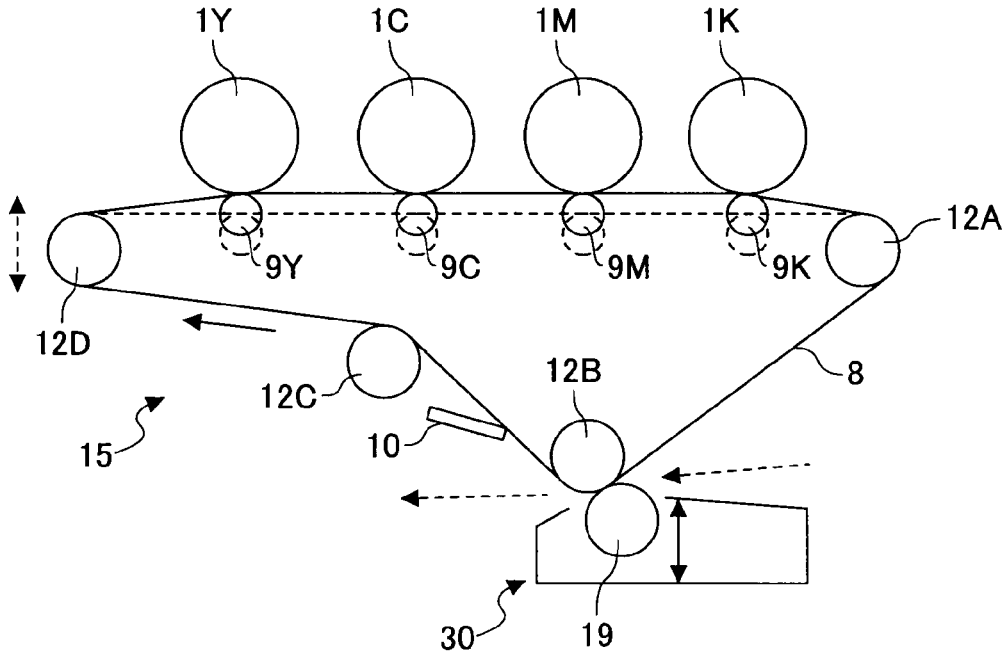
FIG. 3 is a schematic diagram showing a part of the image forming apparatus shown in FIG. 1.

First, referring to FIGS. 1 through 3, a structure and operations of an image forming apparatus according to an embodiment of the present invention are described.

FIG. 1 is a schematic diagram showing the image forming apparatus according to the embodiment of the present invention. In FIG. 1, as the image forming apparatus, a printer is used. FIG. 2 is an enlarged view of an image forming section of the image forming apparatus shown in FIG. 1. FIG. 3 is a schematic diagram showing a part of the image forming apparatus shown in FIG. 1. In FIG. 3, a part near an intermediate transfer belt and a secondary transfer roller is shown.

As shown in FIG. 1, an intermediate transfer belt device 15 is at a central part of an image forming apparatus main body 100. An image forming section 6Y (yellow), an image forming section 6C (cyan), an image forming section 6M (magenta), and an image forming section 6K (black) are arrayed to face an intermediate transfer belt 8 of the intermediate transfer belt device 15. In addition, a secondary transfer roller 19 (member to be contacted) is disposed to face the intermediate transfer belt 8 (member that the member to be contacted contacts).

In FIG. 2, the image forming section 6Y is shown. As shown in FIG. 2, the image forming section 6Y includes a photoconductor drum 1Y; and a charging section 4Y, a developing section 5Y, a cleaning section 2Y, and a discharging section (not shown) disposed to surround the photoconductor drum 1Y. Image forming processes (a charging process, an exposing process, a developing process, a transferring process, and a cleaning process) are performed on the photoconductor drum 1Y, and a yellow toner image is formed on the photoconductor drum 1Y.

Each of the image forming sections 6C, 6M, and 6K has a structure and operations similar to those of the image forming section 6Y. Therefore, in the following, the image forming section 6Y is mainly described as a representative.

In FIG. 2, the photoconductor drum 1Y is rotated counterclockwise by a driving motor (not shown). The surface of the photoconductor drum 1Y is uniformly charged by the charging section 4Y (charging process).

Next, the surface of the photoconductor drum 1Y reaches a position where laser beams L are irradiated from an exposing section 7, and an electrostatic latent image corresponding to a yellow image is formed (exposing process).

Then, the surface of the photoconductor drum 1Y reaches a position facing the developing section 5Y, the electrostatic latent image is developed, and the yellow toner image is formed on the photoconductor drum 1Y (developing process).

After this, the surface of the photoconductor drum 1Y reaches a position where the intermediate transfer belt 8 (belt member) faces a transfer roller 9Y (primary transfer roller), and the yellow toner image on the photoconductor drum 1Y is transferred onto the intermediate transfer belt 8 (first transferring process). At this time, sight amounts of toners not transferred onto the intermediate transfer belt 8 remain on the photoconductor drum 1Y.

Then, the surface of the photoconductor drum 1Y reaches a position facing the cleaning section 2Y, and the not transferred toners remaining on the photoconductor drum 1Y are collected in the cleaning section 2Y by a cleaning blade 2*a* (cleaning process).

Finally, the surface of the photoconductor drum 1Y reaches a position facing the discharging section, and remaining electric charges on the photoconductor drum 1Y are removed by the discharging section.

With this, the image forming processes on the photoconductor drum 1Y are completed.

The above image forming processes are performed in each of the image forming sections 6Y, 6C, 6M, and 6K. That is, the exposing section 7 irradiates laser beams L on the corresponding photoconductor drums 1Y, 1C, 1M, and 1K based on corresponding image signals. Specifically, the exposing section 7 irradiates the laser beams L emitted from a light source on the corresponding photoconductor drums 1Y, 1C, 1M, and 1K via plural optical elements while scanning the laser beams L by using a polygon mirror being rotated.

After the developing process, the toner images on the photoconductor drums 6Y, 6C, 6M, and 6K are superposed on the intermediate transfer belt 8. With this, a color toner image is formed on the intermediate transfer belt 8.

The intermediate transfer belt 8 onto which the color toner image is transferred reaches a position where the intermediate transfer belt 8 contacts the secondary transfer roller 19. At the position, a secondary transfer nip is formed so that the intermediate transfer belt 8 is sandwiched between the secondary transfer roller 19 and a roller 12B (secondary transfer roller facing roller). A high voltage (secondary transfer bias voltage) whose polarity is inverted from the polarity of the toner image is applied to the secondary transfer roller 19.

With this, the color toner image formed on the intermediate transfer belt 8 is transferred onto a recording medium P (paper) (see FIG. 1) transported to the secondary transfer nip (secondary transfer process). At this time, toners not transferred onto the recording medium P remain on the intermediate transfer belt 8. After this, the intermediate transfer belt 8 reaches an intermediate transfer belt cleaning section 10, and the not transferred toners on the intermediate transfer belt 8 are removed by the intermediate transfer belt cleaning section 10.

With this, the transferring processes on the intermediate transfer belt 8 are completed.

Returning to FIG. 1, the recording medium P is transported from a paper storing section 26 at a lower part (or a side part) of the image forming apparatus main body 100 to the secondary transfer nip via a paper transporting roller 27, a pair of registration rollers 28, and so on.

Specifically, plural of the recording media P (paper) are stacked in the paper storing section 26. When the paper transporting roller 27 is rotated counterclockwise, a top recording medium P is transported between the pair of registration roller 28.

The recording medium P transported by the pair of registration rollers 28 is temporarily stopped at a roller nip position of the stopped pair of registration rollers 28. The pair of registration rollers 28 is rotated matching the movement of the intermediate transfer belt 8, and the recording medium P is transported to the secondary transfer nip. With this, the color image is transferred onto the recording medium P.

The recording medium P onto which the color image is transferred at the secondary nip position is transported to a fixing section 20. The color image on the recording medium P is fixed by heat from a heating roller (not shown) and pressure from a pressure roller (not shown) of the fixing section 20.

The recording medium P on which the color image is fixed is output to the outside of the image forming apparatus main body 100 by a pair of paper outputting rollers (not shown). When plural color images are formed on corresponding recording media P, the recording media P are sequentially stacked on a paper stacking section (not shown) as output images.

With this, a series of the image forming processes in the image forming apparatus is completed.

Returning to FIG. 2, the structure and the operations of the image forming section 6Y are described in more detail.

The developing section 5Y includes a developing roller 51Y facing the photoconductor drum 1Y, a doctor blade 52Y facing the developing roller 51Y, two transporting screws 55Y in corresponding two developer containers, a toner supplying route 43Y connecting to one of the developer containers via an opening, and a concentration detecting sensor 56Y for detecting a toner concentration in a developer G. The developing roller 51Y is formed of a magnet (not shown) secured inside the developing roller 51Y, a sleeve (not shown) which rotates around the magnet, and so on. The developer G is formed of a toner carrier and toners, and is contained in the developer containers.

The operations of the developing section 5Y are described.

The sleeve of the developing roller 51Y is rotated in the arrow direction shown in FIG. 2. The developer G transported on the developing roller 51Y by a magnetic field generated by the magnet is moved on the developing roller 51Y by the rotation of the sleeve. The toner concentration (the ratio of the toners in the developer G) in the developing section 5Y is adjusted within a predetermined range.

The toners supplied to one of the developer containers are circulated (in the direction perpendicular to the plane of the paper of FIG. 2) in the two developer containers by the two transporting screws 55Y while the toners are mixed and agitated with the toner carrier.

The toners in the developer G are adhered to the toner carrier by a friction charge with the toner carrier, and are transported on the developing roller 51Y with the toner carrier by a magnetic force generated on the developing roller 51Y.

The developer G transported on the developing roller 51Y reaches the doctor blade 52Y by being transported in the arrow direction shown in FIG. 2. The amount of the developer G on the developing roller 51Y is determined to be a suitable amount by the doctor blade 52Y and the suitable amount of the developer G is transported to a position facing the photoconductor drum 1Y (developing region). The toners are adhered onto the electrostatic latent image formed on the photoconductor drum 1Y by an electric field generated in the developing region. The developer G remaining on the developing roller 51Y reaches an upper part of one of the developer containers and is dropped from the developing roller 51Y into the developing container.

Next, referring to FIG. 3, the intermediate transfer belt device 15 is described in detail.

As shown in FIG. 3, the intermediate transfer belt device 15 includes the intermediate transfer belt 8 (image carrier), four of primary transfer rollers 9Y, 9C, 9M, and 9K, a driving roller 12A, the secondary transfer roller facing roller 12B, a tension roller 12C, a correction roller 12D, and the intermediate transfer belt cleaning section 10. The intermediate transfer belt 8 is wound around the plural rollers 12A through 12D, and is moved in the arrow direction shown in FIG. 3 by the rotation of the driving roller 12A.

Primary transfer nips are formed by sandwiching the intermediate transfer belt 8 between the primary transfer rollers 9Y, 9C, 9M, and 9K and the corresponding photoconductor drums 1Y, 1C, 1M, and 1K. A high voltage (transfer bias voltage) whose polarity is inverted from the polarity of the toners is applied to the primary transfer rollers 9Y, 9C, 9M, and 9K.

The intermediate transfer belt 8 is moved in the arrow direction shown in FIG. 3, and sequentially passes through the primary transfer nips of the primary transfer rollers 9Y, 9C, 9M, and 9K. With this, the toner images on the photoconductor drums 1Y, 1C, 1M, and 1K are transferred onto the intermediate transfer belt 8 by being superposed.

The intermediate transfer belt 8 (image carrier) is formed by dispersing a conductive material such as carbon black on a single layer or plural layers formed of PVDF (poly vinylidene fluoride), ETFE (ethylene-tetrafluoroethylene), PI (polyimide), or PC (polycarbonate). The volume resistivity of the intermediate transfer belt 8 is adjusted to be $10^7$ to $10^{12}$ Ωcm, and the surface resistivity of the rear surface of the intermediate transfer belt 8 is adjusted to be $10^8$ to $10^{12}$ Ωcm. In addition, the thickness of the intermediate transfer belt 8 is adjusted to be approximately 80 to 100 μm, and in the embodiment of the present invention, the thickness of the intermediate transfer belt 8 is approximately 90 μm. In addition, the circumferential length of the intermediate transfer belt 8 is adjusted to be approximately 2197.5 mm.

In addition, if necessary, a die separable coating layer can be formed on the surface of the intermediate transfer belt 8. As the material of the die separable coating layer, there are fluorine resins formed of, for example, ETFE, PTFE (polytetrafluoronethylene), PVDF, PEA (perfluoroalkoxy), FEP (tetrafluoroethylene-hexafluoropropylene copolymer), and PVF (polyvinyl fluoride). However, the material is not limited to the above.

In addition, the intermediate transfer belt 8 can be formed by using an injection molding method, or a centrifugal molding method. If necessary, a polishing process is applied to the surface of the intermediate transfer belt 8.

The primary transfer rollers 9Y, 9C, 9M, and 9K operate to separate the intermediate transfer belt 8 contacting the photoconductor drums 1Y, 1C, 1M, and 1K from the photoconductor drums 1Y, 1C, 1M, and 1K.

Specifically, the primary transfer rollers 9Y, 9C, and 9M for colors are integrally supported by a supporting member (not shown), and are integrally moved in the vertical direction (up-and-down direction). In addition, the primary transfer roller 9K for black is independently moved in the up-and-down direction.

When the primary transfer rollers 9Y, 9C, 9M, and 9K are moved to the broken line position shown in FIG. 3, the intermediate transfer belt 8 is separated from the photoconductor drums 1Y, 1C, 1M, and 1K. That is, the intermediate transfer belt 8 is moved to the broken line position. The separation operation of the intermediate transfer belt 8 from the photoconductor drums 1Y, 1C, 1M, and 1K is performed so as to reduce the deterioration of the intermediate transfer belt 8 caused by friction with the photoconductor drums 1Y, 1C, 1M, and 1K, and is performed when images are not being formed.

When a monochrome image is formed, since only the photoconductor drum 1K is used, it is determined that the primary transfer roller 9K is independently moved. At this time, the primary transfer rollers 9Y, 9C, and 9M are moved downward, and the photoconductor drums 1Y, 1C, and 1M are separated from the intermediate transfer belt 8.

The driving roller 12A is rotated by the driving motor (not shown). With this, the intermediate transfer belt 8 is moved in the arrow direction shown in FIG. 3 (clockwise direction).

The secondary transfer roller facing roller 12B (transfer roller) contacts the secondary transfer roller 19 via the intermediate transfer belt 8. The tension roller 12C contacts the outer circumferential surface of the intermediate transfer belt 8. The intermediate transfer belt cleaning section 10 is at a position between the secondary transfer roller facing roller 12B and the tension roller 12C.

One end of the correction roller 12D is fixed and the other end is moved in the up-and-down direction so that the rotational axle of the correction roller 12D is slanted based on a displacement amount of the intermediate transfer belt 8 detected by a snaking detection sensor (not shown). With this, the displacement (snaking) of the intermediate transfer belt 8 in the width direction is corrected.

In addition, according to the embodiment of the present invention, the secondary transfer roller 19 (member to be contacted) can be moved in the arrow direction shown in FIG. 3 for the intermediate transfer belt 8 (contacting member) by a manual/automatic contacting and separating mechanism 30.

The manual/automatic contacting and separating mechanism 30 is described below in detail. Hereinafter, the manual/automatic contacting and separating mechanism 30 is referred to as a contacting and separating mechanism 30.

Figure 4:
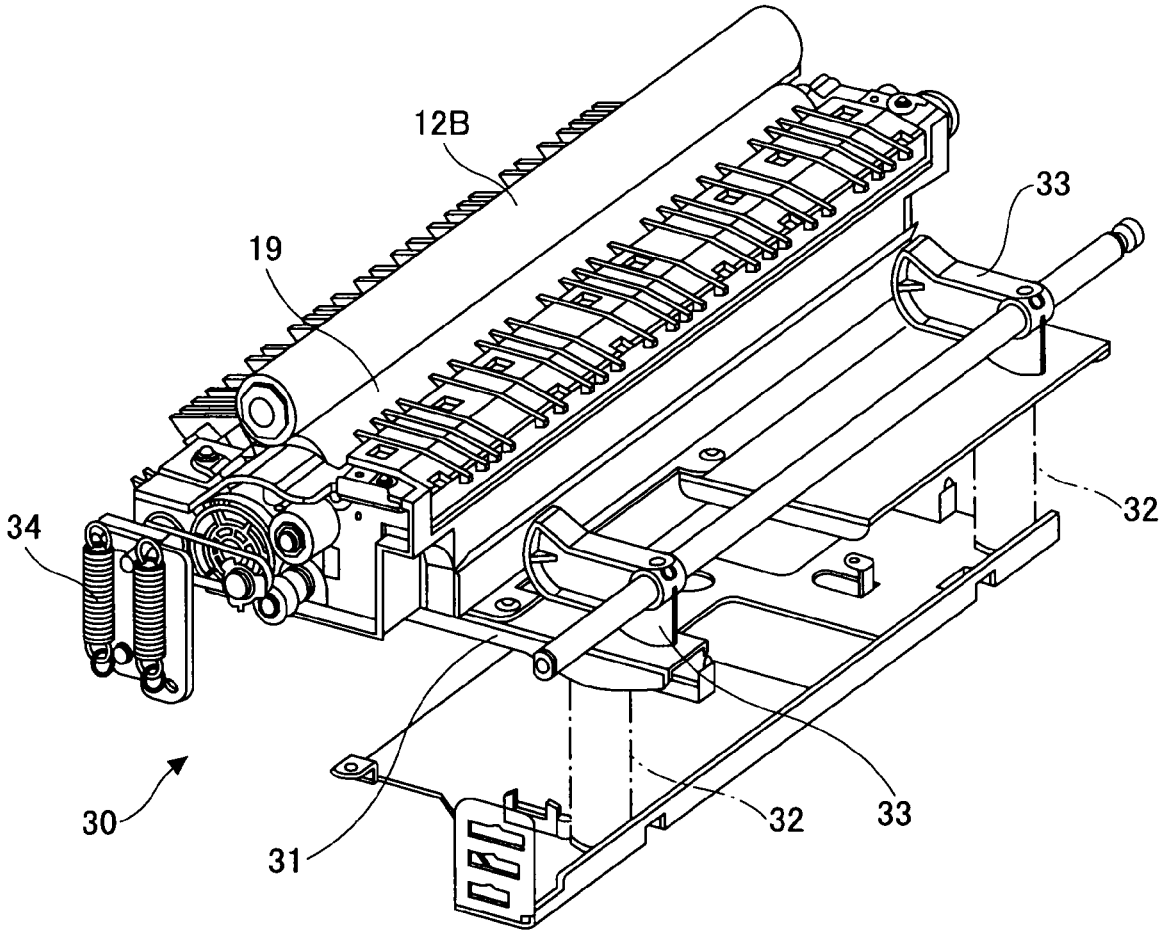
FIG. 4 is a perspective view of a contacting and separating mechanism according to the embodiment of the present invention.
Figure 5:
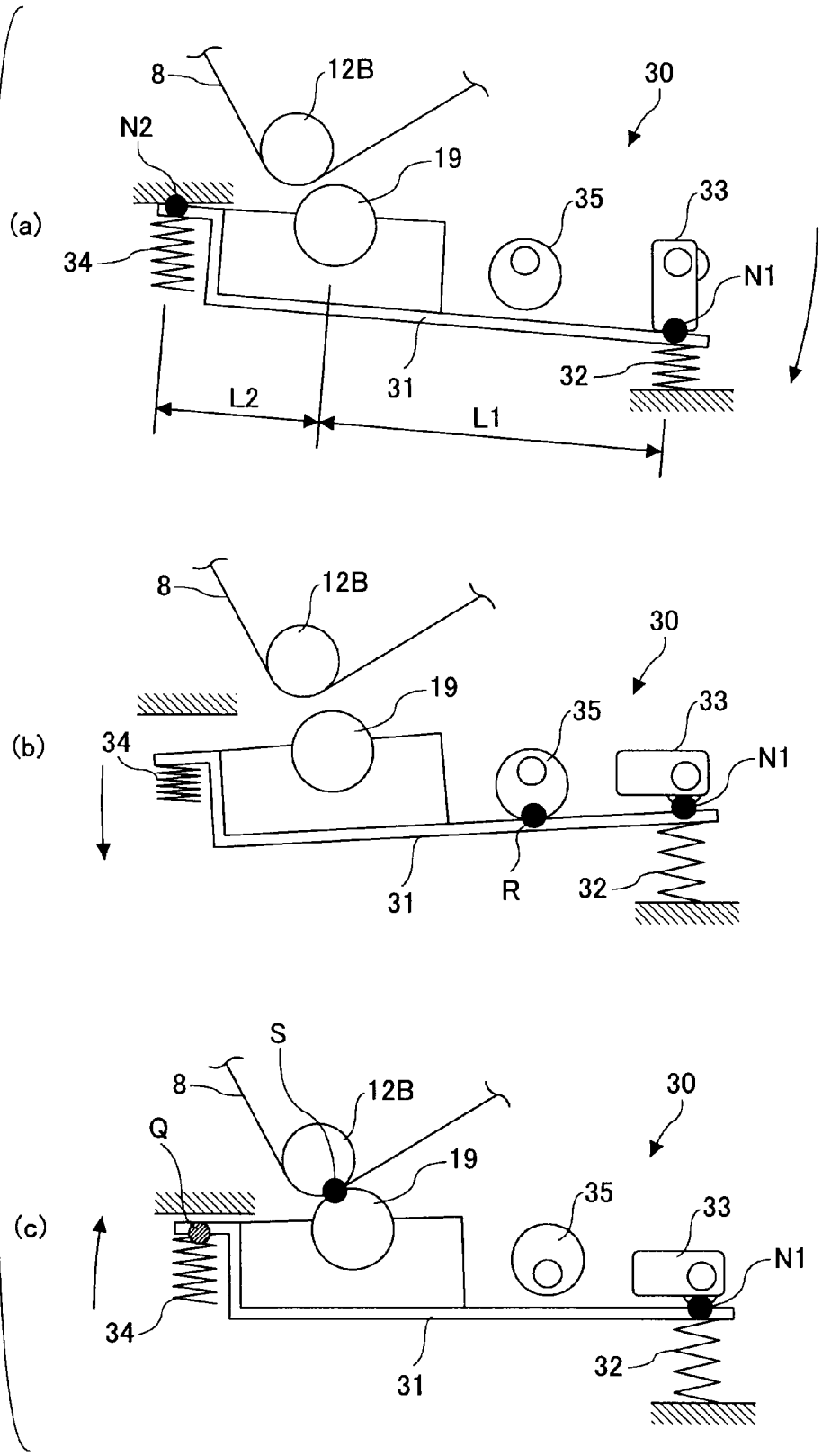
FIG. 5 is a schematic diagram showing operations of the contacting and separating mechanism shown in FIG. 4.

Next, referring to FIGS. 4 and 5, the contacting and separating mechanism 30 is described in detail which causes the secondary transfer roller 19 (first member) to contact the intermediate transfer belt 8 (second member) and separates the secondary transfer roller 19 contacting the intermediate transfer belt 8 from the intermediate transfer belt 8.

FIG. 4 is a perspective view of the contacting and separating mechanism 30. FIG. 5 is a schematic diagram showing operations of the contacting and separating mechanism 30. In FIG. 4, the intermediate transfer belt 8, an automatic cam 35 (second cam member), and one of first springs 34 are omitted. In FIG. 5, simply described, a first spring 34 is formed of a compression spring.

The contacting and separating mechanism 30 functions as a manual contacting and separating mechanism which manually causes the secondary transfer roller 19 to firmly contact the intermediate transfer belt 8 (the secondary transfer roller facing roller 12B) and manually separates the secondary transfer roller 19 contacting the intermediate transfer belt 8 from the intermediate transfer belt 8.

In addition, the contacting and separating mechanism 30 functions as an automatic contacting and separating mechanism which automatically causes the secondary transfer roller 19 to firmly contact the intermediate transfer belt 8 and automatically separates the secondary transfer roller 19 contacting the intermediate transfer belt 8 (the secondary transfer roller facing roller 12B) from the intermediate transfer belt 8 based on control by the image forming apparatus main body 100.

The automatic contacting and separating mechanism (automatic contacting and separating unit) is controlled to separate the secondary transfer roller 19 from the intermediate transfer belt 8 when the secondary transfer process is not being performed. In addition, the manual contacting and separating mechanism (manual contacting and separating unit) is operated by a user and/or a maintenance engineer when, for example, the power source of the image forming apparatus main body 100 is cut off and the secondary transfer roller 19 must be separated from the intermediate transfer belt 8.

As shown in FIGS. 4 and 5, the contacting and separating mechanism 30 includes a pressure applying plate 31 (pressure applying member), a manual cam 33 (first cam member), the automatic cam 35 (second cam member), the first spring 34 (first force applying member), and a second spring 32 (second force applying member).

The pressure applying plate 31 is rotated together with a cabinet holding the secondary transfer roller 19 in automatic and manual contacting and separating rotations. In the cabinet holding the secondary transfer roller 19, a driving section (a gear array, a timing belt, pulleys, and so on) for driving the secondary transfer roller 19, a guiding member for guiding the recording medium P to the secondary transfer nip, and so on are provided.

The pressure applying plate 31 is rotated with a second supporting point N2 near the secondary transfer roller 19 as the rotational center during the manual separating operations, and is rotated with a first supporting point N1 separated from the secondary transfer roller 19 as the rotational center during the automatic contacting and separating operations. The operations of the pressure applying plate 31 are described below.

The manual cam 33 separates the secondary transfer roller 19 contacting the intermediate transfer belt 8 (the secondary transfer roller facing roller 12B) from the intermediate transfer belt 8. The manual cam 33 can be rotated together with a manual lever (not shown) with the shaft of the manual cam 33 as the center.

The user and/or the maintenance engineer rotates the manual cam 33 by operating the manual lever, separates the secondary transfer roller 19 from the intermediate transfer belt 8, performs operations such as removing a jammed recording medium P remaining at the secondary nip, and performs the maintenance of, for example, the secondary transfer roller 19 and the intermediate transfer belt device 15.

As shown in FIG. 5, the manual cam 33 is disposed to contact the pressure applying plate 31 at the first supporting point N1, which is the rotation supporting point during the automatic contacting and separating operations, separated from the secondary transfer roller 19. The second spring 32 is at the first supporting point N1 and pushes the pressure applying plate 31 upward.

Actually, as shown in FIG. 4, two manual cams 33 and two second springs 32 are disposed in the contacting and separating mechanism 30. However, the number is not limited to two, and can be one or more.

As shown in FIG. 5, the automatic cam 35 is eccentrically rotated by being connected to a driving motor (not shown) with the shaft of the automatic cam 35 as the center. The automatic cam 35 is disposed to contact the pressure applying plate 31 between the first supporting point N1 and the secondary transfer roller 19.

The first spring 34 is near the secondary transfer roller 19, pushes the pressure applying plate 31 upward, and causes the secondary transfer roller 19 to contact the intermediate transfer belt 8.

Next, referring to FIGS. 5(*a*) through 5(*c*), the manual separating operations and the automatic contacting and separating operations in the contacting and separating mechanism 30 are described.

In FIG. 5(*a*), in the contacting and separating mechanism 30, the pressure applying plate 31 is rotated together with the secondary transfer roller 19 with the second supporting point N2 as the center, and the secondary transfer roller 19 is separated from the intermediate transfer belt 8.

Specifically, when a user operates the manual lever, the manual cam 33 is rotated counterclockwise and pushes the pressure applying plate 31 downward. At his time, one end (the second supporting point N2 side) of the pressure applying plate 31 contacts a ceiling surface, the pressure applying plate 31 is rotated with the second supporting point N2 as the rotation supporting point, and the position of the first supporting point N1 is moved (changed) downward against the force of the second spring 32. With this, the secondary transfer roller 19 is manually separated from the intermediate transfer belt 8.

When the user rotates the manual cam 33 clockwise by operating the manual lever in the state shown in FIG. 5(*a*), the pressure applying plate 31 is rotated with the second supporting point N2 as the rotation supporting point, and as shown in FIG. 5(*b*) or 5(*c*), the contacting and separating mechanism 30 returns to the state in which the automatic contacting and separating operations can be performed.

As described above, in the contacting and separating mechanism 30, since the manual cam 33 is disposed at the position sufficiently separated from the second supporting point N2 (or the secondary transfer roller 19), the spring force of the second spring 32 can be relatively small, and when the manual cam 33 is rotated, the operating force executed by the user can be relatively small. That is, the operability is increased when the secondary transfer roller 19 is manually separated from the intermediate transfer belt 8.

When the automatic contacting and separating operations are performed by the contacting and separating mechanism 30, as shown in FIGS. 5(*b*) and 5(*c*), the position of the first supporting point N1 is fixed by the manual cam 33 and the second spring 32.

As shown in FIG. 5(*b*), when the secondary transfer roller 19 is automatically separated from the intermediate transfer belt 8, the automatic cam 35 contacts a position R by being rotated to a predetermined angle. With this, the pressure applying plate 31 is rotated counterclockwise together with the secondary transfer roller 19 with the first supporting point N1 as the rotation supporting point against the spring force of the first spring 34.

As shown in FIG. 5(*c*), when the secondary transfer roller 19 is automatically caused to contact the intermediate transfer belt 8, the automatic cam 35 is separated from the pressure applying plate 31 by being rotated to another predetermined angle. With this, the pressure applying plate 31 is rotated clockwise together with the secondary transfer roller 19 with the first supporting point N1 as the rotation supporting point by the spring force of the first spring 34. With this, the secondary transfer roller 19 is stopped by contacting the intermediate transfer belt 8 at a secondary nip position S. At this time, the end Q of the pressure applying plate 31 connected to the first spring 34 does not contact the ceiling surface.

As described above, in the contacting and separating mechanism 30, since the first supporting point N1 is disposed at a position sufficiently separated from the secondary transfer roller 19, even if the parallelism between the secondary transfer roller 19 and the rotation supporting point of the secondary transfer roller 19 is not sufficiently obtained (alignment accuracy is low), great pressure deviation in the width direction (the direction perpendicular to the plane of the paper of FIG. 5) of the secondary transfer roller 19 which contacts the intermediate transfer belt 8 is hardly generated. Consequently, unevenness of an image in the width direction at the secondary transfer process is hardly generated.

In addition, since the automatic cam 35 is disposed at the position between the first supporting point N1 and the secondary transfer roller 19, the size of the contacting and separating mechanism 30 can be relatively small.

As described above, in the contacting and separating mechanism 30 according to the embodiment of the present invention, when the secondary transfer roller 19 is manually separated from the intermediate transfer belt 8, the rotation supporting point of the pressure applying plate 31 is the second supporting point N2, and when the secondary transfer roller 19 is automatically separated from the intermediate transfer belt 8, and when the secondary transfer roller 19 automatically contacts the intermediate transfer belt 8, the rotation supporting point of the pressure applying plate 31 is the first supporting point N1. That is, the supporting points are switched in the corresponding operations.

With this, as shown in FIG. 5(*a*), a distance L1 between the first supporting point N1 and the secondary transfer roller 19 can be sufficiently great. Consequently, the operability of the manual separating operations can be increased and the pressure deviation in the width direction of the secondary transfer roller 19 which contacts the intermediate transfer belt 8 during the automatic contacting operations can be decreased.

That is, in order to surely obtain the above effects, the secondary transfer roller 19 is disposed between the first supporting point N1 and the second supporting point N2, and it is determined that the distance L1 from the secondary transfer roller 19 to the first supporting point N1 is greater than a distance L2 from the secondary transfer roller 19 to the second supporting point N2 (L1>L2). Specifically, the distance L1 is preferably 2 to 3 times the distance L2, and the distance L1 is more preferably 2 to 5 times the distance L2.

Figure 6:
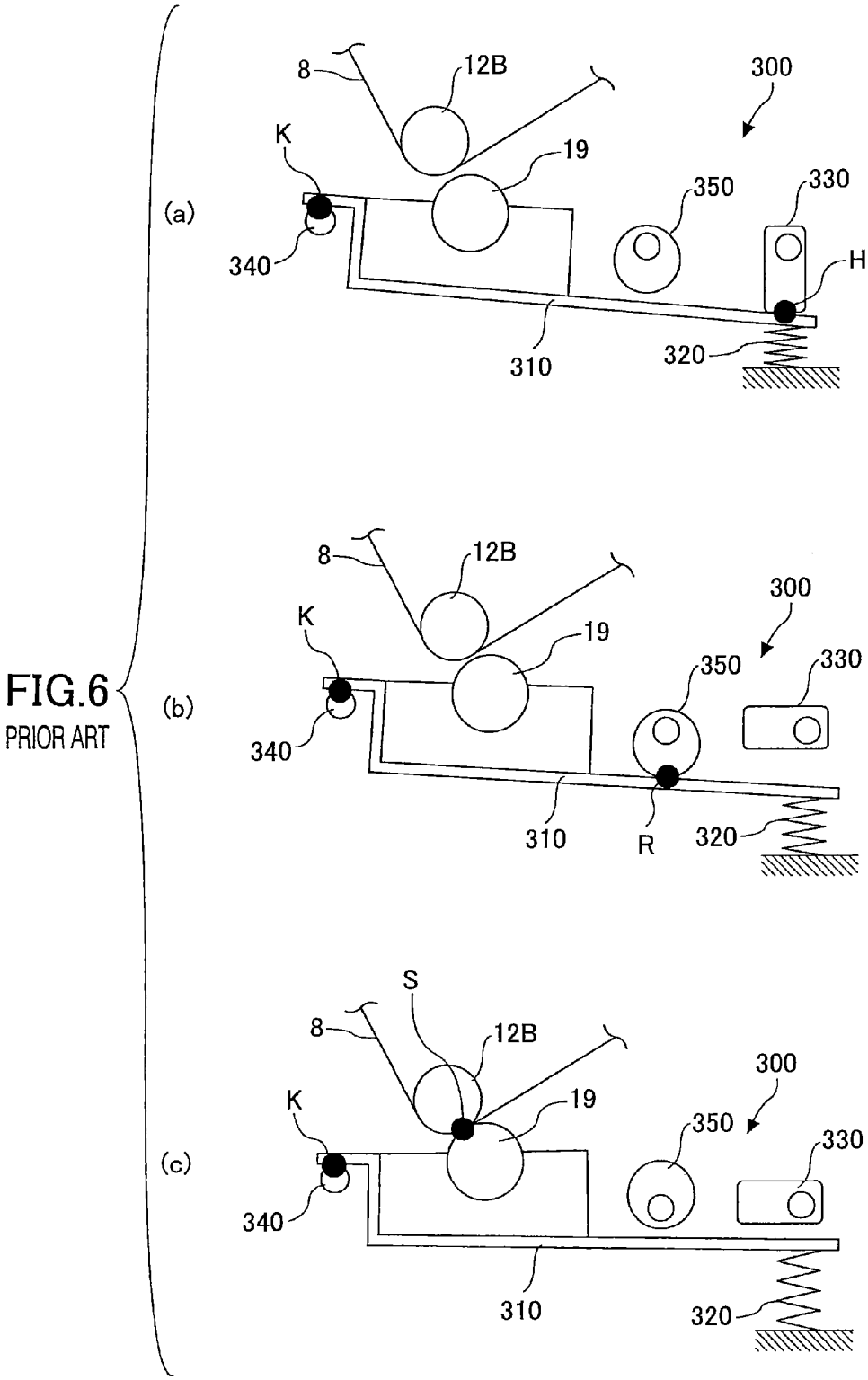
FIG.6 PRIOR ART
FIG. 6 is a schematic diagram showing operations of a conventional contacting and separating mechanism.

Next, referring to FIG. 6, operations in a conventional contacting and separating mechanism are described. FIG. 6 is a schematic diagram showing the operations of a conventional contacting and separating mechanism 300. In FIG. 6, the intermediate transfer belt 8, the secondary transfer roller facing roller 12B, and the secondary transfer roller 19 are the same as those shown in FIG. 5.

In the conventional contacting and separating mechanism 300, a rotation supporting point K of a pressure applying plate 310 is used when the secondary transfer roller 19 automatically contacts the intermediate transfer belt 8, the secondary transfer roller 19 is automatically separated from the intermediate transfer belt 8, and the secondary transfer roller 19 is manually separated from the intermediate transfer belt 8. That is, one rotation supporting point K is used in the operations.

As shown in FIG. 6(*a*), in the manual separating operations, a manual cam 330 is rotated counterclockwise and pushes the pressure applying plate 310 downward against a spring force of a pressure applying spring 320. Since the manual cam 330 and the pressure applying spring 320 are disposed at corresponding positions sufficiently separated from the secondary transfer roller 19, a necessary force can be low at the manual separating operations.

As shown in FIG. 6(*b*), at the automatic separating operations, the manual cam 330 does not contact the pressure applying plate 330, and an automatic cam 350 contacts the pressure applying plate 330 at a point R. With this, the pressure applying plate 330 is rotated together with the secondary transfer roller 19 with the rotation supporting point K as the center.

In addition, as shown in FIG. 6(*c*), at the automatic contacting operations, the manual cam 330 does not contact the pressure applying plate 310, and the automatic cam 350 is separated from the pressure applying plate 310. With this, the pressure applying plate 310 is rotated together with the secondary transfer roller 19 with the rotation supporting point K as the center.

Since a rotational axle 340 of the pressure applying plate 310 is disposed near the secondary transfer roller 19, when the parallelism between the secondary transfer roller 19 and the rotational axle 340 is not sufficiently obtained, great pressure deviation is generated in the width direction of the secondary transfer roller 19 which contacts the intermediate transfer belt 8.

As described above, in the contacting and separating mechanism 30 according to the embodiment of the present invention, when the secondary transfer roller 19 is manually separated from the intermediate transfer belt 8, the rotation supporting point of the pressure applying plate 31 is the second supporting point N2, and when the secondary transfer roller 19 is automatically separated from the intermediate transfer belt 8 and the secondary transfer roller 19 automatically contacts the intermediate transfer belt 8, the rotation supporting point of the pressure applying plate 31 is the first supporting point N1. That is, the supporting points are switched in the corresponding operations.

Therefore, in the contacting and separating mechanism 30 according to the embodiment of the present invention, when the secondary transfer roller 19 is manually separated from the intermediate transfer belt 8, the manual separating operations can be performed without having a relatively great force, and the pressure deviation in the width direction of the secondary transfer roller 19 which contacts the intermediate transfer belt 8 can be reduced.

In the contacting and separating mechanism 30, as a contacting member where a member to be contacted contacts, the intermediate transfer belt 8 is used, and as a contacted member which contacts the contacting member, the secondary transfer roller 19 is used. However, the embodiment of the present invention can be applied to a contacting and separating mechanism which causes a member to contact another member and separates a contacted member from a contacting member, and the same effects as those of the present invention can be obtained in the contacting and separating mechanism.

Further, the present invention is not limited to the specifically disclosed embodiment, and variations and modifications may be made without departing from the scope of the present invention.

That is, the number, the shape, and position of an element in the present invention are not limited to the specifically disclosed embodiment, and can be changed based on the scope of the present invention.

The present invention is based on Japanese Priority Patent Application No. 2007-325236, filed on Dec. 17, 2007, with the Japanese Patent Office, the entire contents of which are hereby incorporated herein by reference.

What is claimed is:

1. An image forming apparatus including a contacting and separating mechanism which causes a first member to contact a second member and separates the first member contacting the second member from the second member, comprising:

a pressure applying member that supports the first member and that is pushed by a force applying member to cause the first member to contact the second member;

a first contacting and separating unit that separates the first member from the second member by changing a position of a first supporting point and by rotating the pressure applying member around a second supporting point corresponding to the position of the force applying member while changing the position of the second supporting point; and a second contacting and separating unit that separates the first member from the second member by rotating the pressure applying member around the first supporting point.

2. The image forming apparatus as claimed in claim 1, wherein the first contacting and separating unit is a first cam member.

3. The image forming apparatus as claimed in claim 2, wherein the pressure applying member includes a second force applying member whose force pushes the pressure applying member at the first supporting point, wherein the first cam member changes the position of the first supporting point against the force from the second force applying member.

4. The image forming apparatus as claimed in claim 1, wherein the first member is manually separated from the second member by the first contacting and separating unit.

5. The image forming apparatus as claimed in claim 1, wherein the second contacting and separating unit is a second cam member.

6. The image forming apparatus as claimed in claim 5, wherein the second cam member contacts and separates from the pressure applying member at a position between the first supporting point and the first member.

7. The image forming apparatus as claimed in claim 1, wherein the first member is automatically separated from the second member by the second contacting and separating unit.

8. The image forming apparatus as claimed in claim 1, wherein the first member is disposed at a position between the first supporting point and the second supporting point.

9. The image forming apparatus as claimed in claim 1, wherein a distance from the first member to the first supporting point is greater than a distance from the first member to the second supporting point.

10. The image forming apparatus as claimed in claim 1, wherein the first member is an image transfer roller; and the second member is an image carrier.

11. The image forming apparatus as claimed in claim 1, wherein the position of the second supporting point, when the first member contacts the second member, is closer to the second member than the position of the second supporting point when the first member is separated from the second member by the second contacting and separating unit.

12. The image forming apparatus as claimed in claim 1, wherein the position of the second supporting point, when the first member is separated from the second member by the first contacting and separating unit, is closer to the second member than the position of the second supporting point when the first member contacts the second member.

13. The image forming apparatus as claimed in claim 1, wherein a direction in which the pressure applying member is rotated when the first member is separated from the second member by the first contacting and separating unit is opposite to a direction in which the pressure applying member is rotated when the first member is separated from the second member by the second contacting and separating unit.

* * * * *